US005184114A

United States Patent [19]

Brown

[11] Patent Number: 5,184,114

[45] Date of Patent: Feb. 2, 1993

[54] SOLID STATE COLOR DISPLAY SYSTEM AND LIGHT EMITTING DIODE PIXELS THEREFOR

[75] Inventor: Brent W. Brown, Smithfield, Utah

[73] Assignee: Integrated Systems Engineering, Inc., Logan, Utah

[21] Appl. No.: 495,006

[22] Filed: Mar. 15, 1990

Related U.S. Application Data

[63] Continuation of Ser. No. 339,778, Apr. 18, 1989, abandoned, which is a continuation of Ser. No. 155,790, Feb. 16, 1988, abandoned, which is a continuation of Ser. No. 738,624, May 28, 1985, abandoned, which is a continuation-in-part of Ser. No. 439,149, Nov. 4, 1982, abandoned.

[51] Int. Cl.[5] ..... G09G 3/32

[52] U.S. Cl. ..... 340/701; 340/767; 340/782; 340/793

[58] Field of Search ..... 340/793, 767, 701, 703, 340/762, 782, 815.1, 815.03, 815.01; 313/500

[56] References Cited

U.S. PATENT DOCUMENTS

| | | | |
|---|---|---|---|
| 3,595,991 | 7/1971 | Diller | 340/782 |
| 3,673,462 | 6/1972 | Girard | 340/331 |
| 3,940,756 | 2/1976 | Findlay | 340/324 M |
| 3,947,840 | 3/1976 | Craford et al. | 340/324 M |
| 4,086,514 | 4/1978 | Havel | 313/500 |
| 4,126,812 | 11/1978 | Wakefield | 313/500 |
| 4,271,408 | 6/1981 | Teshima et al. | 340/702 |
| 4,298,869 | 11/1981 | Okuna | 340/782 |
| 4,367,471 | 1/1983 | Gillessen | 340/825.82 |
| 4,445,132 | 4/1984 | Ichikawa et al. | 357/32 |
| 4,661,809 | 4/1987 | Anderson et al. | 340/793 |

FOREIGN PATENT DOCUMENTS

| | | |
|---|---|---|
| 69665 | 2/1983 | European Pat. Off. . |
| 1482295 | 2/1975 | United Kingdom . |
| 1585394 | 8/1976 | United Kingdom . |
| 2079049 | 6/1980 | United Kingdom . |
| 2131590 | 11/1982 | United Kingdom . |
| 2134302 | 1/1983 | United Kingdom . |
| 2143985 | 7/1983 | United Kingdom . |

*Primary Examiner*—Jeffery A. Brier

[57] ABSTRACT

Wide color range display systems comprising integrated, phase modulated light from three light emitting diode (LED) pixels. Each pixel comprises a large number of LED chips arranged compactly to provide a discrete element light source of sufficient output to be viewed as a point source of light from a substantial distance. The arrays of pixels are placed in a matrix of a type typically used in scoreboards, message centers and other large display systems, although the various combinations, subcombinations, and elements are not limited to such uses. Each pixel is mounted in a molded package which may include a transparent lens covering and sufficient number of connecting leads to provide for the number of colors of LEDs contained in the pixel array. Each pixel is placed in a mounting fixture which also accommodates the necessary electrical connections to multiplexed driving circuitry. The light emitted is determined by the type of LED used in the array, preferably an array of red, green and blue, although amber, green and other color combinations may be used. Using three colors, blue, red, green that are controlled by separate driving circuitry provides the capacity to create any color in the spectrum.

38 Claims, 9 Drawing Sheets

SOLID STATE COLOR DISPLAY SYSTEM AND LIGHT EMITTING DIODE PIXELS THEREFOR

CONTINUITY

This application is a continuation of my copending U.S. patent application Ser. No. 339,778, filed Apr. 18, 1989, now abandoned which is a continuation of my U.S. patent application Ser. No. 155,790, filed Feb. 16, 1988, now abandoned, which is a continuation of my U.S. patent application Ser. No. 738,624, filed May 28, 1985, now abandoned which is a continuation-in-part of my co-pending U.S. patent application Ser. No. 439,149, filed Nov. 4, 1982, now abandoned.

FIELD OF THE INVENTION

This invention relates generally to display equipment and more particularly to a solid state color display system suitable for a color display and discrete elements therefor each comprising a compact array of light emitting diodes.

PRIOR ART

In the convential construction of a large color display system (for example apparatus for displaying advertising, pictures, or the like at stadia, etc.), the words or pictures are formed by selectively turning on or off colored electrical lamps in predetermined pattern (this will produce what is known as cartoon color), or CRT types which are miniature TV screens which then provides the capability to produce true color (any color in the spectrum). Both systems present difficult problems.

The electric lamps have poor color rendition, which results from the fact that the electric lamps bring out colors by having their filaments heated to red heat and assumes a red heat or white orange color. Therefore, in order to produce colors, colored glass filters are used to selectively filter the color desired: Since electric lamps on the order of 7 watts or more have been generally used, a large display (using thousands of lamps) consumes a large amount of electrical power and generates a large amount of heat.

A display using CRTs requires a large amount of power also and, although not much electrical power or heat is generated by the CRT, the circuitry required to drive and control the intensity is extensive and is very costly to manufacture and operate.

Both types of displays are subject to short lamp life, on the order of 8000–10,000 hours, which requires costly maintenance to replace them.

While light emitting diodes (LEDs) have been used in displays, they have been used in small installation or devices such as calculators and indicators. Their use in large displays have been rejected as impractical due to the small amount of luminance available for the standard LED. The luminance emitted by an LED chip over an area of approximately 0.014" by 0.014" (0.0002 square inch area) is diffused over an area of approximately 0.0628 square inches. Therefore, the light is diffused over an area 300 times larger than the source chip and hence the light emitted is unacceptably low.

In those situations, where a discrete LED is used in a matrix, (see Teshima, U.S. Pat. No. 4,271,408) the display would have to use large collimating lens that pick up the luminance from several discrete LEDs.

In array uses of LEDs, such as mentioned by Ichikawa (U.S. Pat. No. 4,445,132), a flat panel display results. The method described by Ichikawa would be useful in small flat panel displays, the density and amount of circuitry required to drive each module would be both costly and prohibitive in a large matrix display used to display alphanumerics and animations.

BRIEF SUMMARY AND OBJECTS OF THE INVENTION

In brief summary, the present invention largely overcomes or alleviates the aforementioned problems of the prior art and provides novel and unobvious solid state color display systems, including the large scoreboard type, and light emitting diode pixels forming the discrete light source elements thereof. A large number of LED chips typically comprise each pixel and the pixels are placed in a matrix and selectively illuminated under the control of driving circuitry. The light emitted is determined by the type of LEDs used in the array. Using three colors, blue, red, green that are controlled by separate driving circuitry, accommodates generation of any color in the spectrum.

Whit the array containing many LEDs spaced at close intervals, the whole array becomes a point source for the light; hence the effective light output is increased to the point that it becomes possible to have satisfactory contrast. The size of the array is determined by the number of LED chips included to achieve the size of pixel desired.

By using red, blue, green chip combinations on the same array with separate connecting leads, a true color system is created which will reproduce any color.

With the foregoing in mind, it is a primary object of the present invention to provide a novel solid state color display system and related method.

Another paramount object of this invention is the provision of a novel solid state discrete pixel, for a color display system, comprising an array of light emitting diodes (LEDs).

A further dominant object is the provision of novel solid state color display systems, including but not limited to large scoreboard type displays, which systems comprise one or more matrices formed of pixels each comprising an array of closely spaced variously colored LEDs which are selectively illuminated.

An additional important object of the present invention is the provision of novel solid state color display systems comprising discrete elements formed of LED pixels having one or more of the following characteristics: (1) on the order of several times the electric to optical efficiency of a conventional lamp discrete display element; and (2) sufficient light intensity to provide sufficient contrast.

Another valuable object to the present invention is the provision of a solid state color discrete light source element comprising a very compact array of sufficient size to generate a light source of any color in the spectrum having sufficient luminous output to be viewed in high ambient light conditions.

A further significant object is to provide a display system comprising discrete color light source display elements comprising an array of light emitting diodes having at least one of the following features: (1) all LED chips are of the same type connected in parallel or series-parallel, (2) the LED chips comprise a plurality of colors, each separately electrically actuated accomodating change in the display image from one color to another; and (3) the LED chips comprise red, green and blue colors, each color being mounted as a group of LEDs in each array and each differentially electrically controlled to vary the intensity of the output of each color whereby any color in the spectrum may be selectively produced.

These and other objects and features of the present invention will be apparent from the detailed description taken with reference to the accompanying drawings.

DETAILED DESCRIPTION OF THE ILLUSTRATED EMBODIMENTS

Reference is now made to the drawings wherein like numerals are used to designated like parts throughout. In general, the Figures illustrate presently preferred color embodiments of solid state display systems and light emitting diode pixels therefor. Each pixel light source comprises a large number of LED chips arranged compactly to provide a discrete element light source of sufficient output to be viewed clearly from a substantial distance (on the order of 300–600 feet or greater). The arrays or pixels of LEDs are placed in a matrix suitable for use in large scoreboard displays, message centers and other large, intermediate and small display systems. Each pixel comprises a sufficient number of connecting leads to provide for each color of LEDs contained in the specific pixel array. Each pixel also accommodates the necessary electric connections to multiplex driving circuitry. The light emitted by each pixel is determined by the type or types of LEDs used in the array. Use of LEDs which produce the three primary colors, red, green and blue, controlled by drive circuitry, provides the capacity to create any one of a plurality of colors.

Discrete elements or pixels in accordance with the present invention provide a light source having satisfactory contrast. The size of each pixel is a function of the number of LED chips included for the type of display needed.

Figure 1:
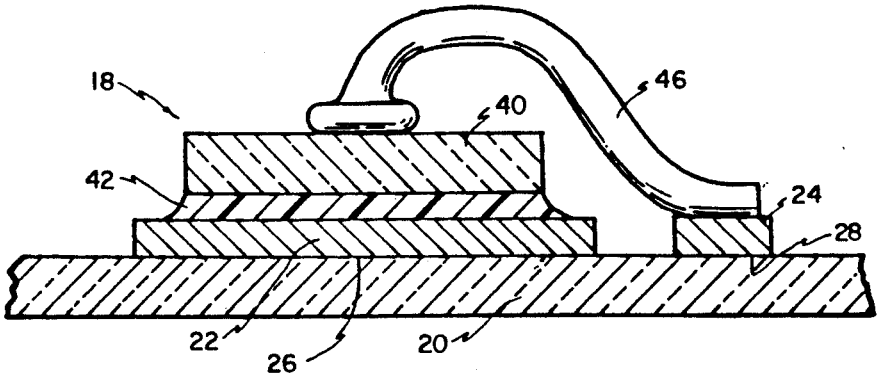
FIG. 1 is a cross section of an LED of an array or pixel in accordance with the present invention mounting to substrate.

As mentioned heretofore, the actual dimensions of each discrete LED pixel or light source, generally designated 18 in FIG. 1, may vary. Once the dimensions have been selected for a given display, an appropriately dimensioned substrate 20 layer is provided. In the illustrated embodiments, the substrate layer 20 can be comprised of glass epoxy printed circuit (PC) board or dielectric ceramic upon which conductive areas are created using thin or thick film technology currently available.

The utilization of such technology produces alternate cathode and anode conductive strips or fingers 22 and 24, respectively. See FIGS. 1 and 4. The manner in which the conductive layers or strips 22 and 24 are produced creates an integral bond at the two interfaces 26 (FIG. 1) between the substrate 20 and each conductive strip 22 and 24. The cathode conductive layers 22 may be joined electrically and an exposed conductive cathode connection terminal provided. Likewise, the anode conductive layers 24 may be electrically joined and an exposed conductive anode connection terminal provided.

LED chips 40 are superimposed upon a layer of commercially available conductive epoxy 42 at predetermined spaced intervals along each cathode conductive layer 22. It is presently preferred that the LEDs be spaced at approximate horizontal and vertical intervals of about 0.050 to 0.10 of one inch to insure that the entire array appears to the eye of the viewer as a point source of light. After all LEDs are in place, the substrate is heated sufficient to melt the conductive epoxy under each led chip. After the conductive epoxy has cured, the chip is thereby bonded in place. A conductive wire 46 is connected from the anode of each LED chip 40 to the adjacent common anode conductor or strip 24. The process of bonding each connecting wire or conductor 46 to the anode of each LED chip 40 and to the adjacent anode conductor 24 is well known and need not be described in this specification.

Figure 2:
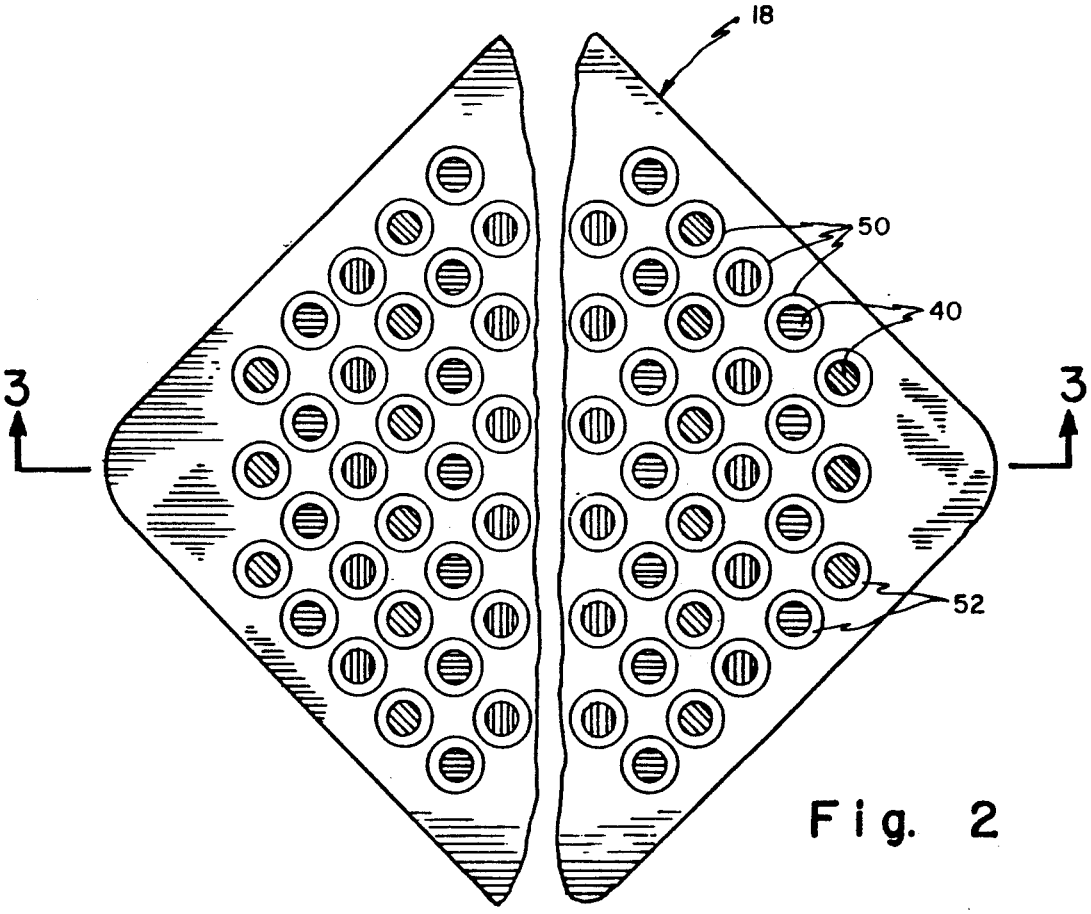
FIG. 2 is an enlarged front view of a tri-color [red, green, blue (RGB)] LED array or pixel in accordance with the present invention.

It is presently preferred, as illustrated in FIG. 2, that each discrete LED pixel or light source 18 comprise red, green and blue LEDs arranged in a pattern, such as alternate rows and driven so that the intensity or brightness of each color may be selectively varied between zero and maximum intensity whereby, when the three primary colors are integrated, any desired color may be displayed by the pixel 18.

Figure 3:
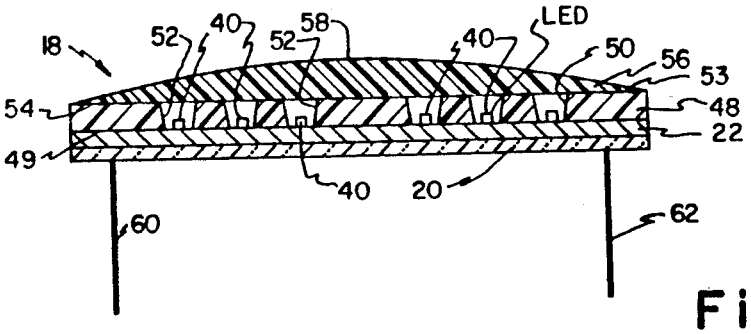
FIG. 3 is a reduced scale cross section of the LED array or pixel taken along lines 3—3 of FIG. 2.

It is also presently preferred, as illustrated in FIG. 3, that provision be made at each pixel for avoiding loss of light intensity. More specifically, a reflector plate 48 may be contiguously superimposed, at the back surface 49 thereof, upon the front surface of the layer 22 comprising the cathode and anode conductors. Reflector plate 48 comprises a plurality of tapered apertures 50 arranged for each to receive, at the base thereof, one of the pixels in visually exposed relation. The apertures 50 are illustrated as being circular and as providing an outwardly divergent tapered reflective surface 52. A transparent lens 56 is continuously superimposed, at the flat back surface 54 thereof, upon the flat forward surface 53 of the reflector 48. The forward surface 58 of the lens 56 has a curved shape or is crowned. Individual collimating lenses may also be molded over individual LEDs.

Figure 4:
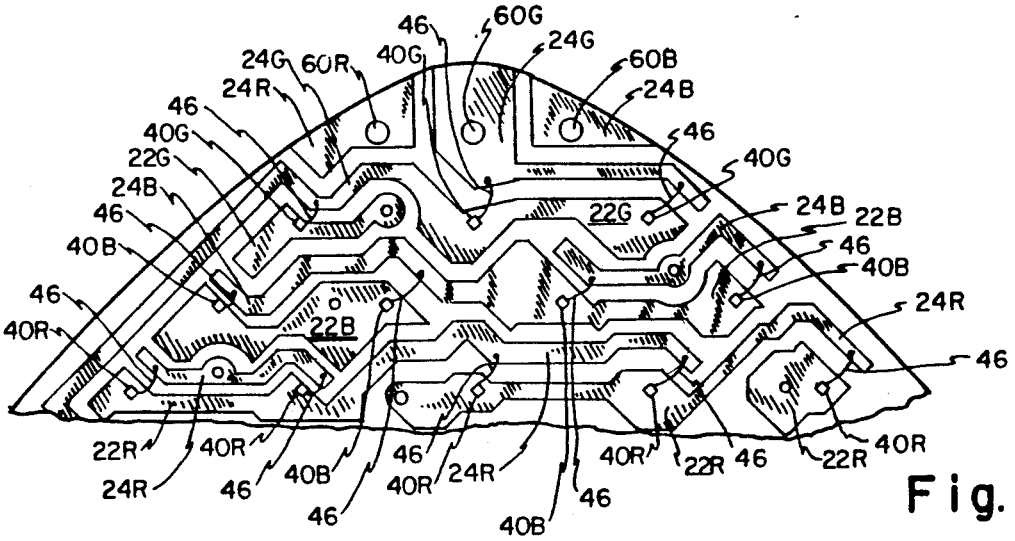
FIG. 4 is a front view of a typical series-parallel cathode/anode printed circuit board forming a part of the illustrated LED pixel.

Each pixel 18 comprises an anode pin 60 for each color and a cathode pin 62 for each color. See FIG. 3. Each RGB pixel 18 thus has separate red, green and blue cathode pins 62R, 62G and 62B, and separate red, green and blue anode pins 60R, 60G and 60B. The red, green and blue cathode conductors 22 are respectively connected to the red, green and blue cathode pins 62. All red, green and blue anode conductors 24 are respectively connected to the red, green and blue anode pins 60. A presently preferred arrangement of red, green and blue cathode and anode conductors 22R, 22G and 22B and 24R, 24G and 24B is illustrated in FIG. 4. Red, green and blue LEDs are respectively designated 40R, 40G and 40B, in FIG. 4.

Figure 5:
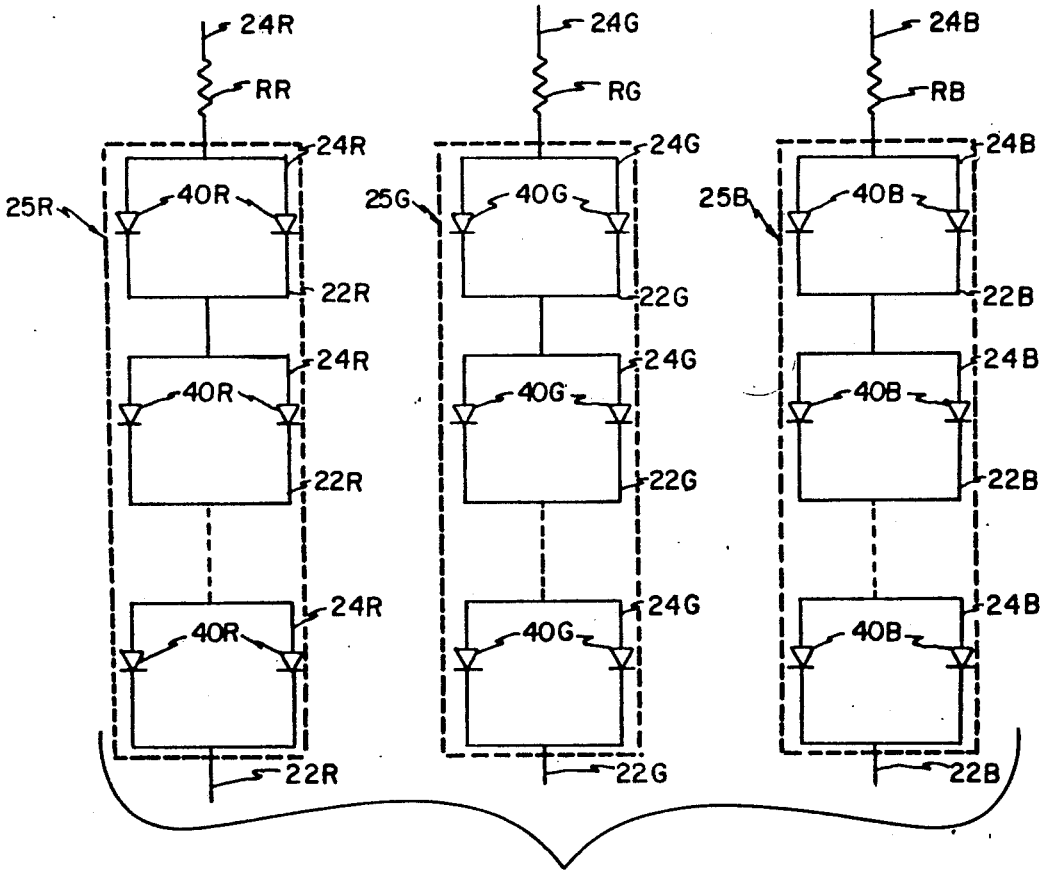
FIG. 5 is a series-parallel anode/cathode circuit diagram for LED pixels according to the present invention.

The series-parallel printed circuit of FIG. 4 is shown schematically in FIG. 5. Application of a separate voltage pulse having a predetermined voltage to each of the respective groups of red, green and blue anode connectors of a pixel provides the capacity to produce any one of a plurality of colors ranging across the entire spectrum. Resistors RR, RG and RB are respectively used in series with the RGB anode terminals, respectively to cause all LEDs forming any one of the three RBG circuits to have a selected uniform brightness. The collective red, green and blue LED circuits of each pixel are designated 25R, 25G and 25B, respectively in FIG. 5.

Figure 6:
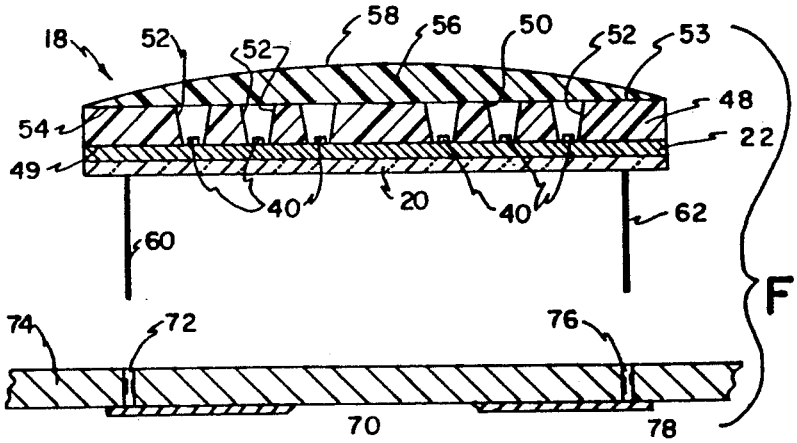
FIG. 6 is an exploded cross section of a typical electrical connection arrangement for an LED pixel in accordance with the present invention.

Reference is now made to FIG. 6 which show presently preferred structure for connecting each discrete LED light source arrays 18 to driving circuitry. Specifically, each anode conductive pin 60 (one each for red, green and blue), mounted to substrate backing 20, is inserted into a matching conductive female receptacle 72 of a driving circuitry anode conductor 70. One such anode conductor 70 is provided for each of the three RGB pins 60.

The three anode pins 60 are respectively aligned with and are releasably press fit into female electrical receptacles 72 of the driving circuitry. The three female receptacles 72 for each pixel are firmly carried by a mounting display printed circuit board 74. Similarly, the three cathode pins 62 of each pixel 18 are respectively aligned with and are releasibly press fit into conductive electrical receptacles 76 of the driving circuitry. Each of the three receptacles 76 is electrically connected to its own separate cathode conductor 78.

Figure 7:
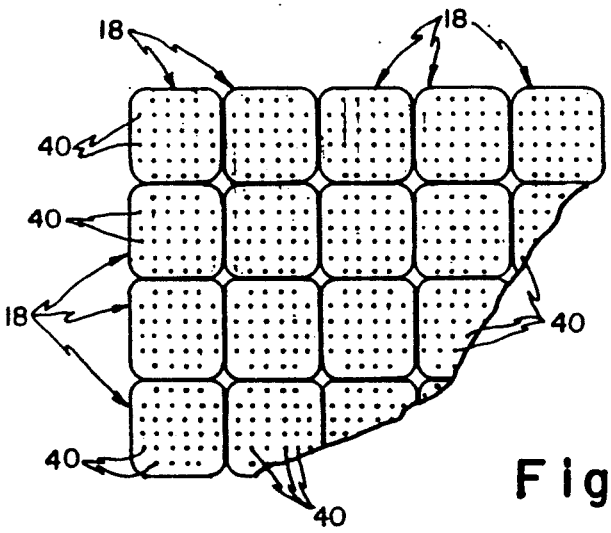
FIG. 7 is a fragmentary front view of a matrix display using LED pixels according to the present invention.

When all of the pixels 18 of a given display system have been mounted to the board 74, as described, the display configuration of FIG. 7 is created.

Figure 8:
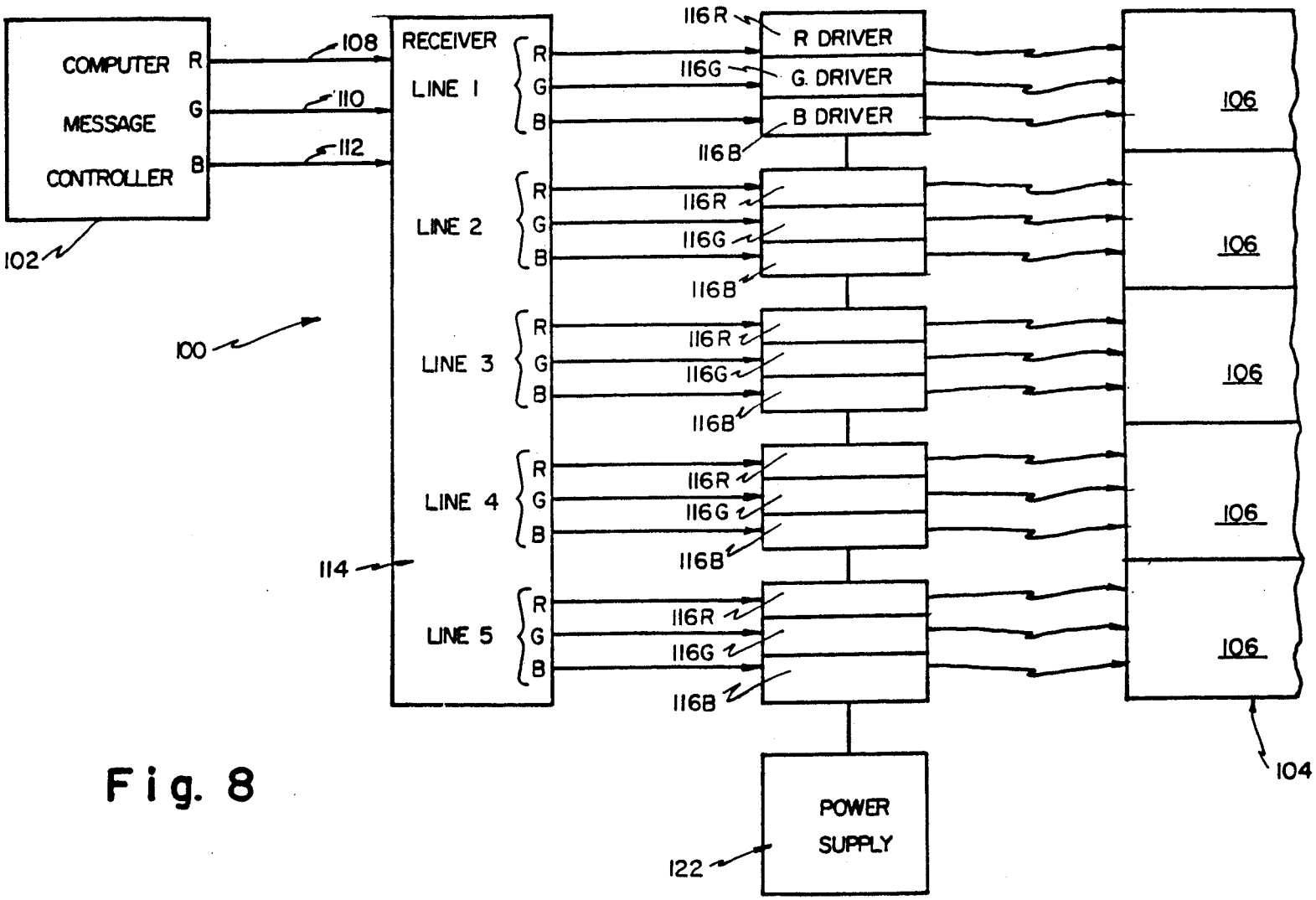
FIG. 8 is a schematic block diagram of an eight color RGB digital display system driven by a computer controlled message center.

One presently preferred and representative multicolor matrix driving circuit 100 is shown in FIG. 8. Circuitry 100 uses an available computer controlled message controller 102. The message controller 102 is conventionally programed to produce a series of red, green and blue digital signals so that a corresponding visual image is presented on the face of a scoreboard or like display 104. Display 104 is illustrated as comprising one hundred twenty eight (128) columns and forty (40) rows of pixels 18, made up of five (5) panels 106 each comprising one hundred twenty eight (128) columns and eight (rows) of pixels 18. Displays of other sizes can be used as desired.

The computer generated RGB digital data (in raster scan format), describing the "on", "off" and intensity of each LED of each tri-color pixel and representative of the image to be displayed, is transmitted in a known and suitably modulated serial data format from the computer controlled message controller 102 along RGB conductors 108, 110 and 112, respectively, to a serial receiver apparatus 114. Controller 102 can be any suitable commercially available computer controlled message controller. For example, a model 1000 EC controller with three display interfaces [part no. 11231 available from Integrated Systems Engineering, Inc. of Logan, Utah]. Three data bits are required to define the desired state of each pixel 18. One bit is, therefore, assigned to control each of the three colors of the pixel 18. In this manner, each pixel 18 can be directed to emit any one of eight colors. This type of color rendering is known as cartoon color.

The receiver 114 may be a single integrated device for the signals for all three colors or separate receivers, one for the signals for each of the three colors. Suitable serial receivers are also available from Integrated Systems Engineering, Inc. For example, part no. 10003 may be used for each of the three receivers. The receivers 114 de-multiplexes, respectively distributes or switches the RGB data and routes 8 rows of said data via three RGB independent cable conductors to an 8 row driver 116R, 116G, 116B. Five drivers of each type, i.e. five 116R, five 116G and five 116B are required, one of each for each 8 row display panel 106. Each driver 116R, 116G, 116B may comprise part no. 10000 available from Integrated Systems Engineering, Inc.

A power source 122 supplies electrical energy to the drivers 116R, 116G and 116B and to the pixels 18 of the display 104. If desired, more than one power source may be substituted for source 122. One suitable power source is part no. 10025 available from Integrated Systems Engineering, Inc.

Figure 9:
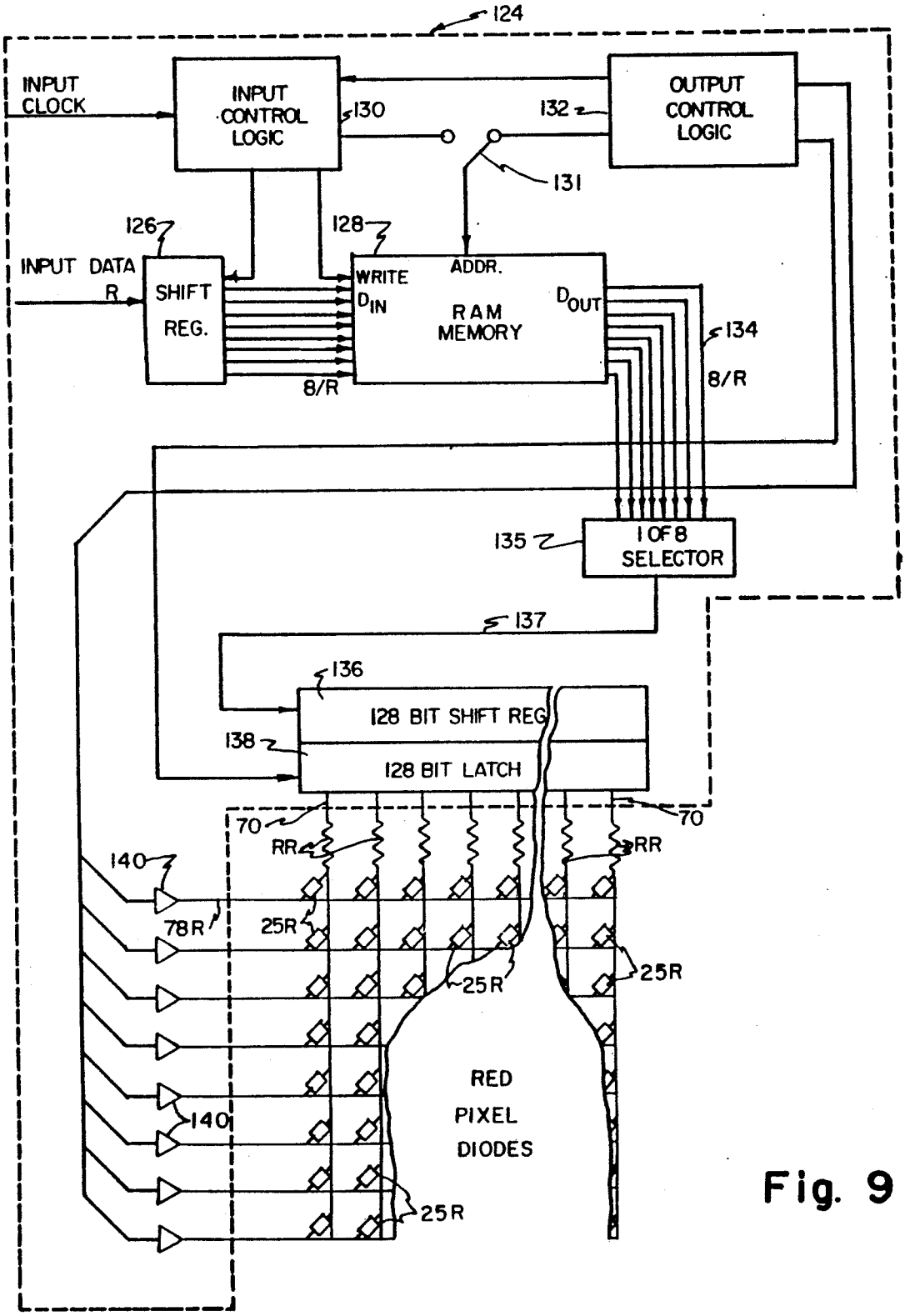
FIG. 9 is a schematic of a typical RGB driver circuit forming part of the system of FIG. 8.

The details of one of the RGB driver circuits 116R, 116G, 116B for an 8 color digital LED display is illustrated in FIG. 9. Specifically, the red driver circuit 116R is illustrated and described, it being understood that the 116G and 116B are structurally and functionally the same.

In the driver circuit 116R, red rows of digital data, issued from the receiver 114, are communicated serially to a conventional shift register 126, where the 8 serial bits of input data are converted to a parallel word, and from thence the parallel data are addressed and written to a RAM memory 128 using the eight input conductors, preferably during a frame update.

An output control logic signal, issued by the logic 132, is communicated to input control logic 130 which enables a write cycle to occur in a conventional fashion, with switch 131 connecting logic 130 and memory 128 for correct addressing of data.

The RAM memory 128 uses a time shared process for outputting the data to the multiplexed display in such a fasion that each discrete element image and the color thereof are periodically refreshed.

With the address switch 131, positioned as shown in FIG. 9, and with output control logic 132 disabling input control logic 130 and shift register 126 so that temporarily no further red data are written into RAM memory 128. Red data are properly addressed and caused to be output, using the eight output conductors 134, from RAM memory 128 to a 1 of 8 selector or demultiplexer 135, which selects one of eight rows of data and communicates the same along conductor 137 to red shift register 136 and from thence across latch circuit 138 along anode conductors 70R to the columns of red LED circuits 25R of the display. Buffers 140 supply current across cathode conductors 78R to the red LEDs on a row by row sequential basis. Selector 135 may be demultiplexer part no. HC151 and decoder part no. HC237, available from Motorola, Texas Instruments, among others.

While only red pixel diodes are illustrated in FIG. 9 and while only the operation thereof has been described for one 8 row display panel, it is to be appreciated that the remainder of the red and all of the green and blue pixel diodes are identically connected and utilized.

Thus, the driver circuits 116R, 116G, 116B buffer the data and, using conventional LED multiplexing techniques, drives rows and columns of LED pixels. In this way, three independent sets of outputs are utilized to drive the rows and columns.

Figure 10:
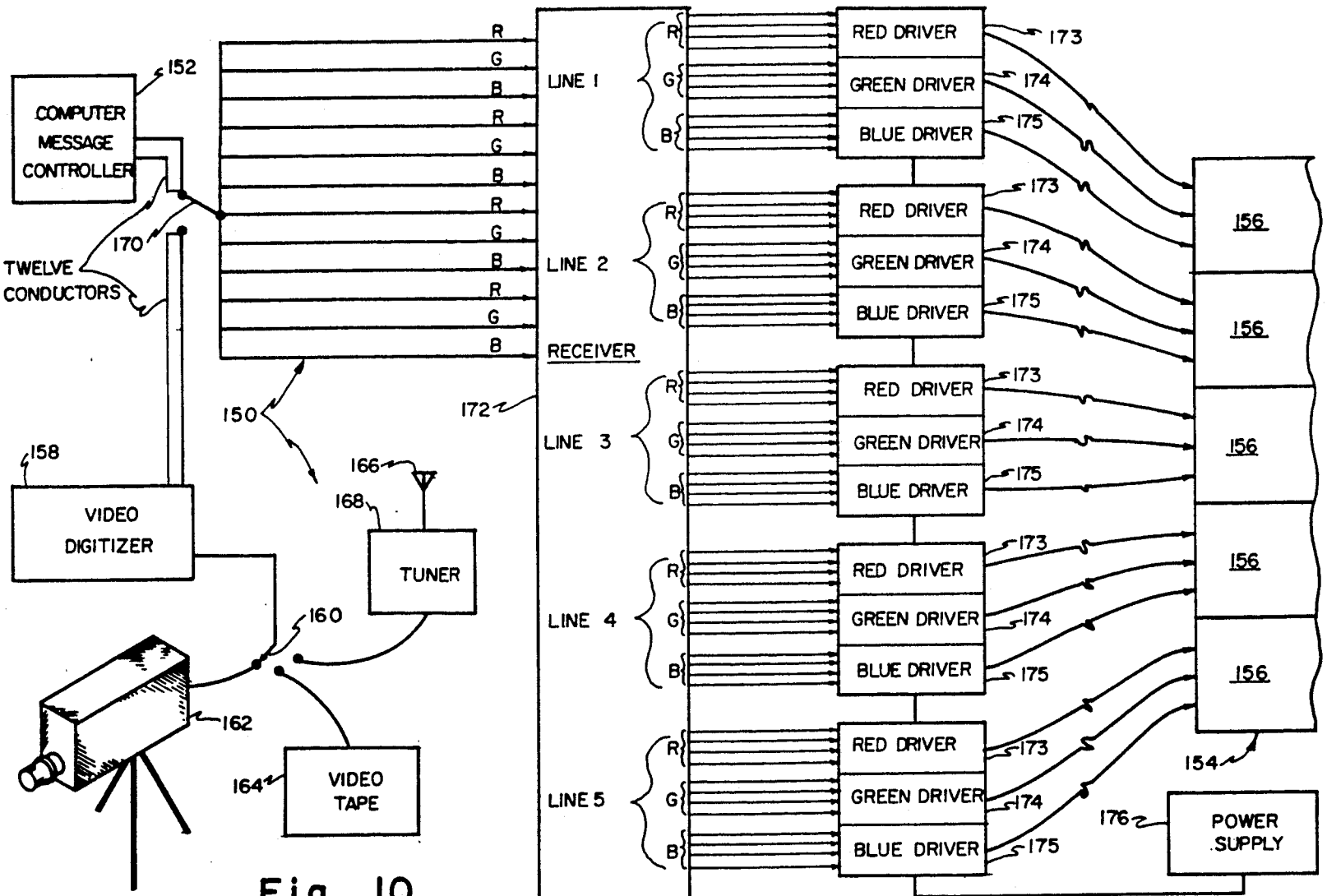
FIG. 10 is a schematic block diagram of another RGB 4096 color digital display system optionally driven by either a computer controlled message center or a video digitizer.

Another presently preferred and representative multi-color matrix driving circuit 150 is shown in FIG. 10. Circuitry 150 comprises an available computer controlled message controller 152, which is comparable to controller 102, but conventionally programmed to produce four digitized bits of red, green and blue data, respectively (12 bits/pixel). In this way, any one of 4096 colors may be selected and displayed at any pixel 18 of an LED pixel display 154. Display 154 is illustrated as comprising sixty-four (64) columns and forty (40) rows of pixels 18, made up of five (5) panels 156 each comprising sixty-four (64) columns and eight (8) rows of pixels 18. Displays of other sizes may be used.

Circuitry 150 comprises an additional or alternative source of data, i.e. a video digitizer 158, which receives video signals across switch 160 from any suitable source of video signals such as a video camera 162, a VCR 164 or broadcasted video (tv) signals via antenna 166 and tuner 168.

A switch 170 allows the user to select between controller 152 and digitizer 158 as a source of video input. In either case, data digitized into 12 bits/pixel are transmitted, across twelve (12) conducts (4 each for RGB data, respectively), to a serial receiver 172. This data is in row-by-row raster scan format, and describes the on, off and intensity level for each color of each LED of each tri-color pixel. The data, collectively represents the image to be illuminated at the display 154.

The receiver 172 de-multiplexes and distributes or switches the 12 bits of RGB data and routes 8 rows of data via independent conductors to the drive electronics of RGB drivers 173, 174 and 175. Each driver 173, 174 and 175 contains red, green and blue electronics, respectively.

A power source 176 supplies electrical energy to the drivers 173, 174 and 175 and to the pixels 18 of the display 154.

Figure 11:
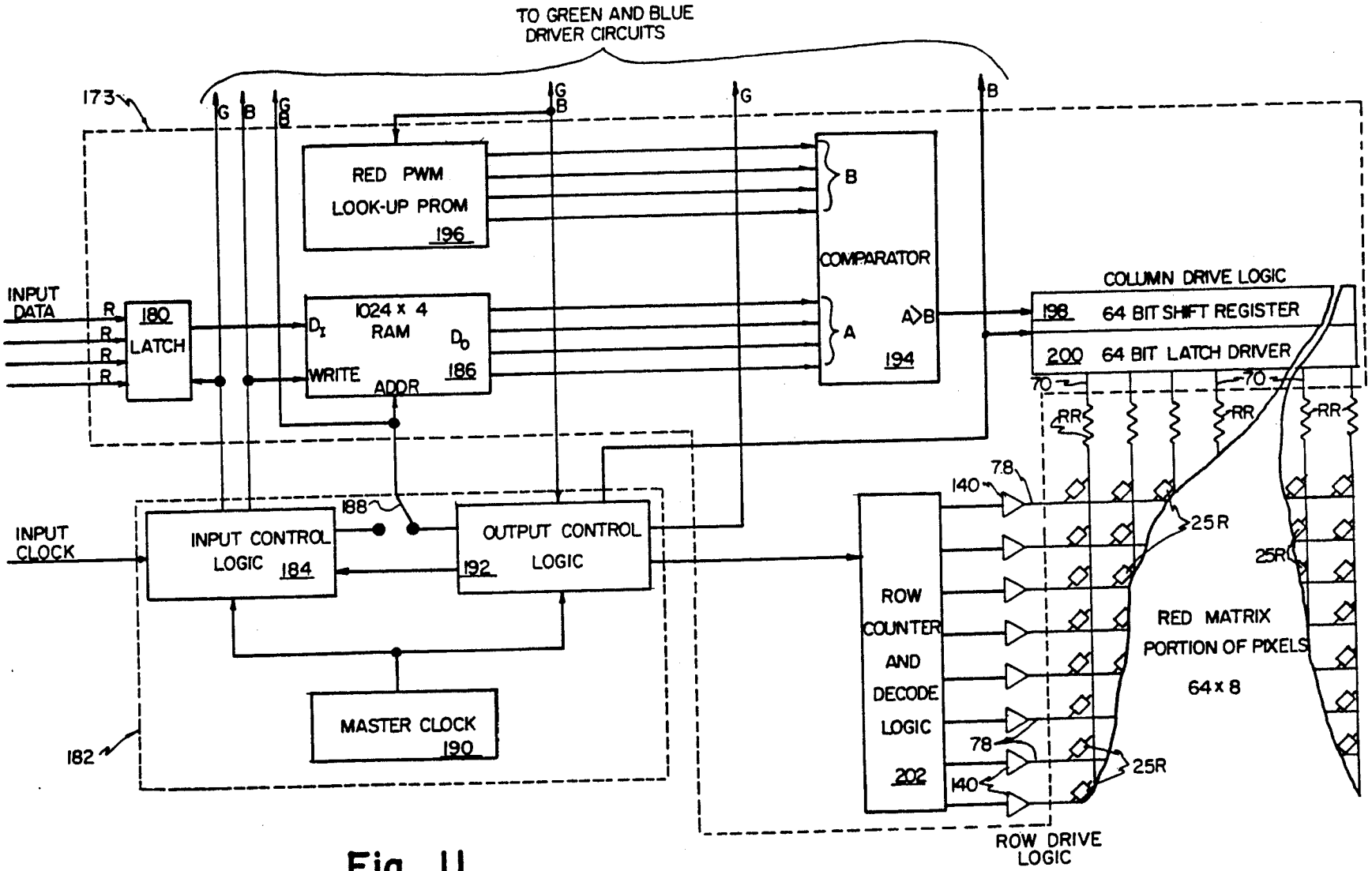
FIG. 11 is a schematic of a driver circuit forming a part of the display system of FIG. 10.

In each RGB driver circuit 173, 174 and 175, RGB rows of digital data (four bits/color), issued from the receiver 172, are respectively communicated to red, green and blue latch circuit. One such latch circuit 180 for red driver 173 is shown in FIG. 11. The latch 180 captures and retains data until the input logic is allowed to process it into the memory, i.e. the latch 180 is a temporary buffer.

Apart from the control logic 182 of FIG. 11, which is common to the driver circuits 173, 174 and 175 for each 8 row panel 156 of the display 154, each color has its separate, although identical 8 row driver electronics. Accordingly, only one driver circuit needs to be described, i.e. circuit 173, illustrated in FIG. 11.

An input clock pulse, issued by the receiver 172, is communicated to input control logic 184 to control or enable the transfer of data into the red RAM memory 186 in a conventional fashion, with Switch 188 connecting logic 184 and red memory 186 for correct addressing of data under the timing control of master clock 190. Input control logic 184 causes newly received data to be written into RAM memory. RAM memory 186 holds the digital image of the current display. Master clock 190 establishes system timing requirements.

The RAM memory 186 uses a time shared process for outputting the data, under the timing control of master clock 190 and output control logic 192, to the red pixel LED multiplexed display in such a fashion that each image and the color thereof are periodically refreshed. Output control logic causes the current contents of the RAM to be read out for display processing.

With the switch positioned as shown in FIG. 11 and with output control logic 192 disabling input control logic 184 so that temporarily no further data is written into RAM memory 186, red data, for example, are caused to be output from RAM memory 186 along four conductors to one side of a comparator 194. Four conductors also connect the other side of comparator 194 to a PWM Prom 196. Comparator 194 compares the output of the RAM to the output of the PWM Prom looking for conditions when data in the RAM should cause the associated LEDs to be turned on. PWM is a programmable Read Only Memory, which contains the look-up table which causes the RAM data to conform to a pulse width modulated brightness scheme containing 16 different intensities.

The PWM Prom 196 is a decoding pulse width modulation permanently programed Read Only Memory which uses a window technique to control when and for how long pixel color data is output from RAM 186 through comparator 194 to shift register 198, i.e. so long A input is greater than B input. The Prom look-up table is customized to match the light output characteristics of the three different color LED dice.

As an example, a single row of data may be be processed from RAM 186 to column drive shift register 198 sixty four (64) times in 1.0 millisecond. Thus, all 8 rows are processed in 8 milliseconds. Continuous scanning of all 8 rows every 8 milliseconds yields a refresh rate of 125 frames per second (fps). This is sufficient to reduce flicker and make the image appear solid to an observer.

Under control of logic 192, column data stored in register 198 is communicated across latch driver 200 along anode terminals 70 to the columns of red LED circuits 25R to one panel of the display. Buffers 140 supply current to the cathode terminals 78 of the red LEDS of one panel, on row-by-row sequential basis, under control of logic 192 and row counter and decode logic 202.

While only red pixel diodes for 8 rows of the display are illustrated in FIG. 11 and while only the operation thereof has been described, it is to be appreciated that the remainder of the red as well as all of the green and blue pixel diodes are identically connected and utilized.

Restated, the system of FIGS. 10 and 11 utilizes the digital approach of the light method, and a digital form of pulse width modulation to drive each color within a pixel at any desired one of sixteen different intensities.

Thus, 4 bits are used to define each LED's brightness level, and 12 bits define the entire pixel. This yields 4096 different color combinations. This large number of color combinations is sufficient to reproduce a video image so that an observer will experience realistic color reproduction.

The system of FIGS. 10 and 11 is operated in a manner similar to the eight color of FIGS. 8 and 9. In addition to the computer, a video source is added as an input alternative.

The receiver functions essentially the same as in the eight color system of FIGS. 8 and 9.

The driver also functions similar to the eight color system; however, the separation of the color signals into independent buffers produces the desired brightness based on 4 bit data analysis.

To keep flicker to a minimum and accomplish pulse width modulation within the time periods of the normal refresh cycle, the data rates from the buffer to the output shift registers must be greatly increased over the eight color method. The encoded data from the Ram 186 is compared to the output of a PWM Prom. The output of the Prom determines the length of 15 "on" states or conditions for each of the 16 possible brightness levels. (State zero, the 16th state, is an "off" state). Comparing the pixel color data to the PWM prom output will let either a 1 of 0 shift out to turn "on" or "off" a color within a pixel. The longer the value of the pixel data exceeds the value produced by the PWD Prom, the higher will be apparent brightness of the LED.

Figure 12:
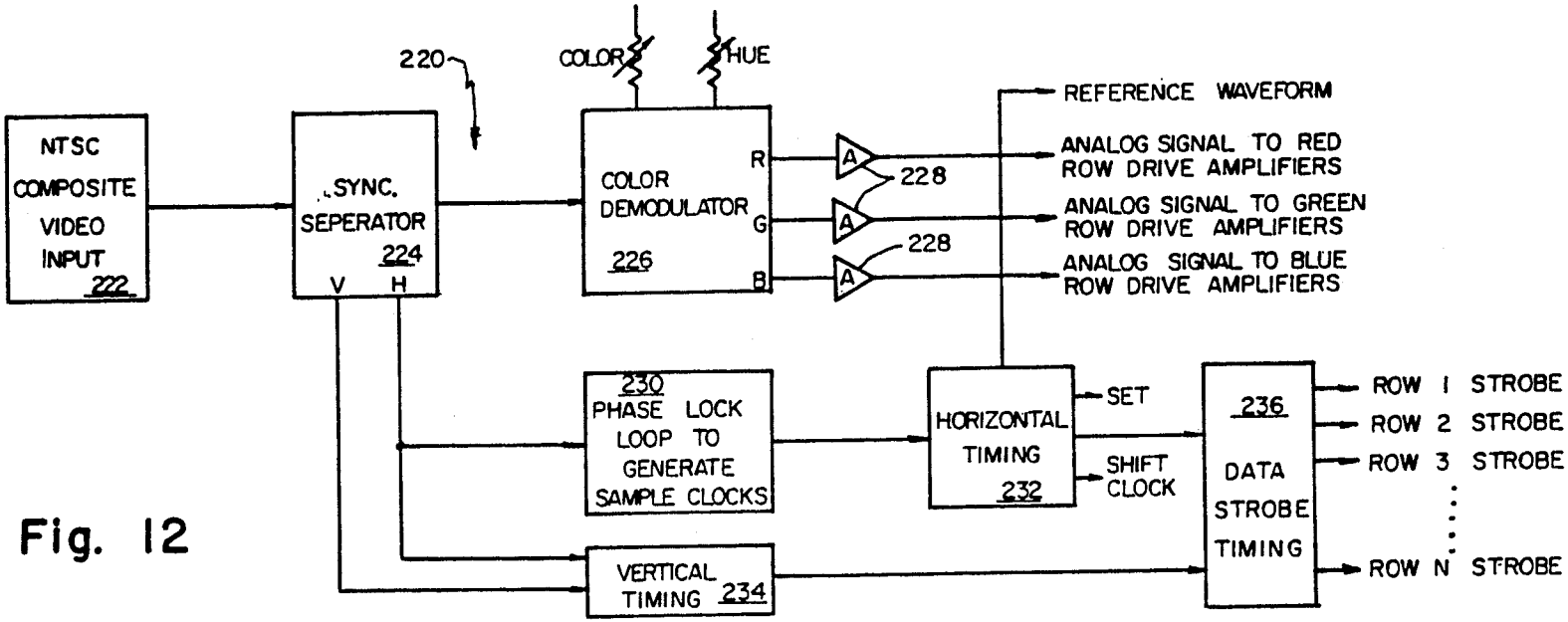
FIG. 12 is a schematic block diagram of a RGB analog display system which processes composite video to the LED pixel display of the present invention.
Figure 14:
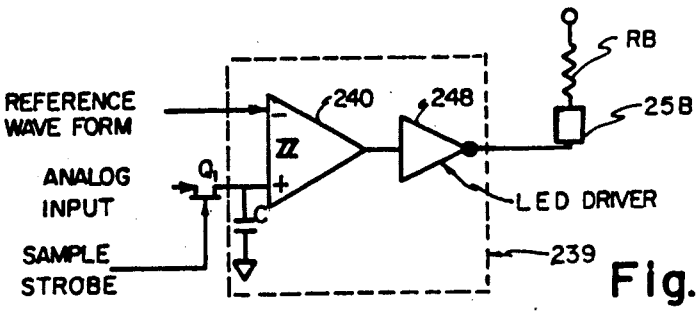
FIG. 14 is an enlarged fragmentary circuit diagram of part of the circuit of FIG. 13 by which selected LEDs of any pixel are turned on and off and the brightness thereof controlled.
Figure 13:
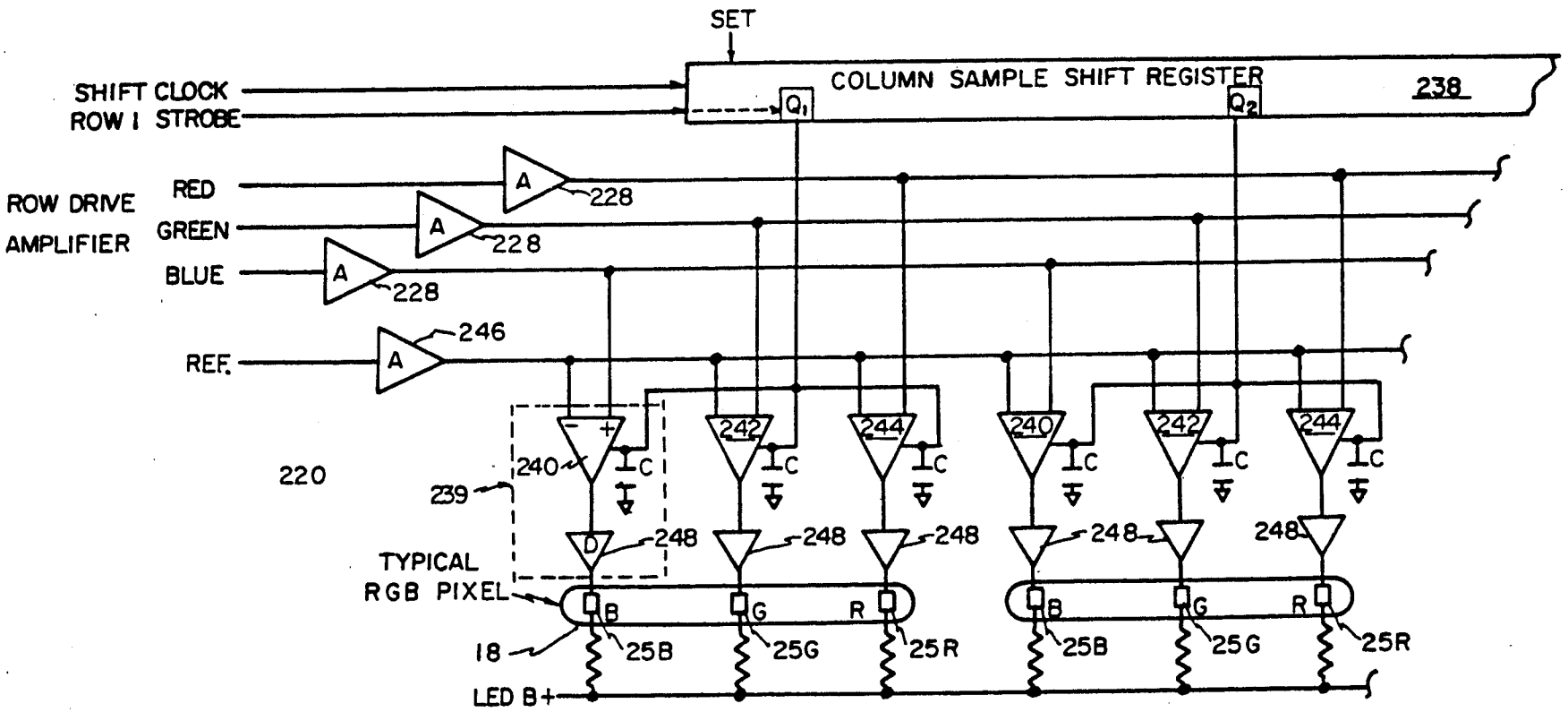
FIG. 13 is a schematic of analog RGB driver circuitry used in conjunction with the display system of FIG. 12.

Another multi-color matrix driving circuit 220, suitable for converting an NTSC, PAL or SECAM composite video into a continuously variable RGB display using analog data and tri-color LED pixels, is shown in FIG. 12–14. Circuitry 220 comprises a source of NTSC, PAL or SECAM composite video 222. See FIG. 12.

Using known techniques, synchronized separator 224 and a color demodulator 226, with output amplifiers 228, are used whereby the NTSC signal is broken into its five primary components, i.e. horizontal synch (H), vertical sync (V), a continuously varying signal proportional to the amount of red in the picture (R), a continuously varying signal proportional to the amount of green in the picture (G), and a continuously varying signal proportional to the amount of blue in the picture (B).

The H signal is applied to a PLL (phase lock loop) 230 which produces a high frequency clock pulse. This clock pulse determines, in conjunction with horizontal timing circuit 232, the start of each video line, and establishes how often the video is sampled.

The V signal is used, in conjunction with the vertical timing circuit 234, to determine the start of frame timing. V and H, in conjunction with data strobe timing circuit 236, select which rows of video will go to the LED pixel display.

The final outputs, as a result of the described processing of the H and V signals will: (1) set a start bit sequentially into each row of column sample shift register 238 (FIG. 13); (2) shift the bit from left to right within shift register 236 as each successive pixel is sampled; (3) output a strobe pulse to each row of pixels as such is updated; and (4) produce a reference wafeform of sufficiently high frequency to reduce the flicker that would otherwise result if the LEDs were pulsed at normal video rates.

Each pixel color requires a separate pulse width modulation decoder to establish the desired elements brightness. This is accomplished with a sample and hold circuit voltage comparator circuit, shown in FIGS. 13 and 14 and hereinafter described.

With reference to FIG. 13, the set, shift clock and row strobe signals, eminating as described above, are delivered to a column sample shift register 238, while the RGB sequential pixel signals are respectively communicated to the positive terminal of separate RGB comparators 240, 242 and 244. The reference waveform, ampified at 246, communicated to the negative terminal of each comparator 240, 242 and 244.

The video is sampled in succession by the action of the shift register 238 and the row strobe pulse. The value of the video is stored in the sample and hold comparator circuit 239. Using one field of a video frame, this value is updated 30 times per second.

With specific reference to FIG. 14, which is an enlargement of one comparator circuit 239, the video signal is sampled when transistor Q is strobed "on", and stored in capacitor C. A reference waveform voltage is compared to the voltage stored in capactitor C. So long as the voltage in capacitor C is greater than the value of the reference, the output, across driver 248, will turn the associated LED's on. When the reference is greater than the voltage stored in capacitor C, the LEDs are "off". Thus, the longer any LED is "on" within the period, the greater the brightness and vice versa.

An update rate of 30 Hz is too slow to prevent flicker, so the reference waveform with a repetition rate in excess of 120 Hz is compared to the stored video. This comparison will yield a pulse, the width of which will be in proportion to the stored analog voltage. Thus each LED is pulse width modulated to yield the desired brightness.

The invention may be embodied in other specific forms without departing from the spirit or essential characteristics thereof. The present embodiments are therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letter Patent is:

1. A large matrix display system comprising:

an array comprising a large number of juxtaposed multi-color solid state integrated pixels and means arranging the pixels in a close matrix pattern;

each pixel comprising an exposed face comprising a plurality of differently colored separate LEDs and means compactly arranging the LEDs so that each pixel is an apparent point composite color light source to an observer of the array;

a plurality of separate conductor means forming a part of each pixel, one separate conductor means for the LEDs of each color, means by which each conductor means electrically communicates only with all of the LEDs of one color of the pixel whereby a coordinated series of different signals is respectively communicated to the LEDs of each color to sequentially visually create at each pixel A succession of composite colors one after another ranging across a large number of color combinations;

means comprising a source of separate but coordinated series of signals for the LEDs of the same color for each pixel of the matrix display;

means controlling and delivering said coordinated series of signals separately but simultaneously respectively to the LEDs of same color of each pixel of the matrix display in such a manner that each pixel will, at any point in time, display only one composite color from within said large number of color combinations comprising a visual integration of the period of illumination of each LED of each pixel produced by each of the plurality of coordinated signals delivered to the differently colored LEDs of each pixel and said one composite color of each pixel will sequentally change from time to time as said plurality of coordinated signals from said source means and controlling and delivering means change whereby images of composite colors, which vary with time across the spectrum of a large number of color combinations, are successively visually illuminated on the matrix display.

2. A matrix display comprising:

a plurality of multi-color solid state LED pixels;

each multi-color pixel comprising a plurality of differently colored electrically independent sets of LEDs and means arranging the LEDs of each pixel in a closely spaced pattern;

each set of differently colored LEDs of each pixel being electrically interconnected by separate conductor means;

means electrically separating the conductor means to the LEDs of one color at each pixel from the conductor means to the other LEDs at each pixel;

source means of separate but coordinated series of separate signals collectively representative of the desired mixed color intensity to be visually obtained at each point in time from each pixel of the display;

a plurality of separate means, one for each LED color at each pixel, by which said series of separate signals are simultaneously communicated respectively to each set of LEDs of each color of each pixel whereby (a) the resulting color mix at each pixel displayed to an observer at each point in time is a composite integration of the separate color intensity level signals simultaneously but separately delivered to the respective LEDs of each color of the pixel, (b) the composite color displayed to an observer of all pixels of the display will at each point in time comprise an integrated image comprising many colors across a large number of color combinations, and (c) the image and many colors thereof will change from time to time as the color intensity level signals of the series changes.

3. The display according to claim 2 wherein the plurality of separate means comprise drive circuit means which systematically, sequentially and separately drive the LEDs of each color of each pixel of the display via the series of signals.

4. The display according to claim 3 wherein the driver circuit means comprise memory means for temporarily storing said signals and means selectively outputting the stored signals to the LEDs in a scan format.

5. The display according to claim 4 wherein the driver circuit means comprise digital data signal generating means.

6. The display according to claim 4 wherein the driver circuit means comprise analog or digital pulse width modulated signal generating means by which period of illumination is controlled.

7. The display according to claim 3 wherein the driver circuit means comprise means for the refreshing the color of the LEDs of each pixel during the time interval of each image by recommunicating the current series of data from storage to the LEDs.

8. The display of claim 2 wherein each of the plurality of separate means comprise means which demultiplexes the signals and routes the demultiplexed signals in a row-by-row format to driver circuit means.

9. The display according to claim 8 wherein the drive circuit means comprise time share memory means for storing the demultiplexed signals and control logic means for outputting said signals from the memory means.

10. The display according to claim 9 wherein the control logic means causes the demultiplexed signals to be output to scan means from which each series of signals are repeatedly communicated on a sequential basis to the LED pixels.

11. The display according to claim 2 wherein said source means comprises video digitizer means.

12. The display according to claim 2 wherein said source means comprises computer means.

13. The display according to claim 2 wherein said source means comprises means issuing NTSC, PAL, or SECAM television signals.

14. The display according to claim 2 wherein sample and hold means are interposed between standardized value means and the means communicating each output signal to retain the period of illumination of each color of each LED for each pixel for extended periods of time.

15. The display according to claim 2 comprising pulse width modification means which determine the period of illumination of each LED of each pixel in association with each of the plurality of separate means by which image flicker is minimized.

16. The display according to claim 2 wherein the pixels and the plurality of separate means are arranged so that the signals occur in a row and column format.

17. A matrix display comprising:

a plurality of tri-color solid state LED pixels;

each tri-color pixel comprising three differently colored electrically independent sets of LEDs and means arranging the LEDs of each pixel in a closely spaced pattern;

each set of tri-colored LEDs of each pixel being electrically interconnected by separate conductor means;

means electrically separating the conductor means to the LEDs of one color at each pixel from the conductor means to the other LEDs at each pixel;

source means of three separate but coordinated series of signals collectively representative of the desired mixed color intensity to be visually obtained at each point in time from each pixel of the display;

three separate means, one for each LED color at each pixel, simultaneously communicating said three series of separate signals respectively to each set of LEDs of each color of each pixel whereby (a) the resultant color mix at each pixel displayed to an observer at each point in time is a blended integration of the colors illuminated at each set of LEDs which corresponds to the period of LED illumination signals simultaneously but independently delivered to each of the respective LEDs of each color of the pixel, (b) the composite color displayed to an observer of all pixels of the display collectively will at each point in time comprise an integrated image comprising a large number of color combinations across a color spectrum, and (c) the image and many colors thereof of the display will change from time to time as the signals representing the color intensity level of each set of LEDs of each pixel changes.

18. A matrix display according to claim 17 wherein the three sets of LEDs per pixel comprise red, green and blue LEDs, respectively.

19. A matrix display according to claim 17 wherein the source means comprise means by which data signals are derived and the source means further comprise means issuing a plurality of data bits for the three differently colored sets of LEDs of the pixels respectively by which the number of available composite color visual outputs is exponentially increased.

20. A matrix display according to claim 17 wherein the source means comprise means by which data signals are derived and further comprising means by which the data signals are respectively delivered to the sets of LEDs is in a refreshing modulated scan data format, means controlling the rate there of so that it substantially exceeds the rate at which data signals are issued from the source.

21. A matrix display according to claim 17 wherein each of the three separate means of each pixel connect respectively to anode means of the associated set of LEDs.

22. A method of presenting successive visual images on a matrix display comprising;

providing a plurality of tri-color solid state LED pixels arranged in a pattern;

connecting the LEDs of each tri-color pixel to comprise three differently colored sets of LEDs;

causing each set of tri-colored LEDs of each pixel to be electrically interconnected by separate conductor means;

issuing three separate but coordinated series of signals per pixel from a source, the signals collectively representative of the desired hue and intensity to be obtained at each point in time from each set of differently colored LEDs of each pixel of the display;

simultaneously communicating said three separate signals per pixel separately to each set of differently colored LEDs of each pixel whereby (a) the color mix displayed at each pixel to an observer at each point in time is a single color comprising a blended integration of the color illuminated at each set of LEDs which corresponds to the duration of illumination determined by signals simultaneously but separately delivered to each of the three sets of LEDs of each pixel, (b) the composite color displayed to an observer of all pixels of the display collectively will at each point in time comprise an intelligible integrated image comprising many hues across the color spectrum, and (c) the image and many hues of the display will change from time to time as the signals representing the intensity level of each set of LEDs of each pixel change.

23. A method of displaying images of varying colors within the spectrum on a matrix display comprising:

providing an array comprising a large number of juxtaposed multi-color solid state integrated LED pixels arranged in a close matrix pattern, each pixel comprising sets of differently colored compactly arranged LEDs so that each pixel is an apparent composite point color light source to an observer of the array;

controlling and selectively and separately electrical communicating from a source of video or computer signals several separate but coordinated series of signals respectively to each set of LEDs at each pixel;

producing multi-color illumination at many if not all of the pixels at any point in time which visually comprise only one composite color at each pixel of a large number of color combinations resulting from selective illumination of the sets of differently colored LEDs of the pixel respectively which corresponds to the plurality of coordinated signals separately delivered to each set of LEDs of each pixel;

changing said one composite color at each pixel from time to time as said plurality of coordinated signals changes whereby successive integrated images each comprising varying array of composite colors across the spectrum are sequentially visually illuminated on the matrix display.

24. A method by which composite color images are successively displayed on a matrix display comprising:

presenting a plurality of multi-color solid state LED pixels arranged in a pattern for visual observation;

constructing each multi-color pixel so that it comprises a plurality of differently colored sets of LEDs;

electrically interconnecting each set of differently colored LEDs of each pixel by separate conductor means;

issuing separate but coordinated signals along said separate conductor means respectively, the signals being representative of the desired color and intensity to be obtained at each point in time from each set of differently colored LEDs of each pixel of the display;

communicating said signals separately along said separate conductor means respectively to each set of differently colored LEDs of each pixel;

obtaining a single composite visual color at least many of the pixels at each point in time comprising a blended integration of the colors independently displayed at each set of LEDs forming the pixel which corresponds to the separate illumination duration determining signals simultaneously delivered to the differently colored sets of LEDs of each pixel;

displaying an integrated matrix image of many colors over a large number of color combination across the spectrum comprising a visual integration of the single composite visual color being displayed at said pixels at each point in time; and changing the images and colors, across said large number of color combinations, of said display from time to time as the intensity level signals to the respective sets of LEDs of each pixel change.

25. A method of sequentially presenting different images each comprising a different arrangement of many colors from a wide range of colors comprising the steps of:

simultaneously issuing separate signals from a source;

separately communicating the separate signals respectively to electrically independent sets of LEDs of each of many pixels of a matrix display which signals collectively represent many colors of the large number of color combinations;

controlling the period of illumination and intensity of each set of LEDs at each pixel with said signals to exactly and simultaneously produce (a) an LED color mix at each pixel visually comprising a single desired color from the large number of color combinations, and (b) a large readable display image comprising an image integration of the single mixed colors at each pixel; and repeating said issuing, separately communicating and controlling steps to change the single composite color visually displayed at selected pixels and the integrated visual image of the display to another desired pattern of many colors.

26. LED illumination apparatus adapted to a large LED matrix display system which provides a large number of color combinations, said LED illumination apparatus comprising:

signal source means which provide an independent signal for each primary color;

LED pixel means wherein each pixel comprises a plurality of LEDs comprising different primary colors, said LED pixel means providing one apparent source of light in the large matrix display, said light comprising an integral sum of the light from said LEDs to provide one color at any one point in time of a large number of color combinations;

LED means interconnected in series and parallel diode matrices which provide X-Y addressing means without non-LED integrated circuits in said LED matrix;

pulse wave modulation means comprising:

LED addressing and exciting means which address and excite each LED of each pixel to illumination at the same instant;

LED illumination extinguishing means which extinguish each LED independently at a variable time after the LEDs of a pixel have been illuminated, providing a duration of LED ON time which is dependent upon the strength of the signal from the signal source means for the color to be emitted by that LED;

pixel addressing means which provide X-Y row, column addressing of pixels which selectively address multiple columns and groups of rows to reduce peak current levels and provide refresh rates which will eliminate apparent flicker;

pixel module means, in combination, providing arrays of apparent point sources of light which provide a picture comprising a large number of color combinations.

27. LED illumination apparatus according to claim 26 wherein pulse wave modulation means comprise PROM memory means which provide a predetermined linear and non-linear conversion of signals from said signal source means to time modulation means which provide corrections for variations in performance of LEDs of different colors across the range of signal strengths as received from the signal source means.

28. LED illumination apparatus according to claim 26 wherein LED pixel means comprise pixel module means which provide serial/parallel arrays of LEDs with at least two LEDs of each color, said pixel module means providing levels of illumination required for large arrays and providing LED redundancy for increased pixel reliability.

29. LED illumination apparatus according to claim 26 wherein pulse wave modulation means comprise refresh means which provide refresh rates which are of a sufficiently high frequency that a viewer does not perceive flicker caused by variable illumination time of the individual LEDs.

30. An LED matrix display system for large number of color displays, comprising:

message control means which provide a means of providing previously prepared messages for display;

video digitizer means which provide digitized voltage levels of video signals;

mode selection means which select between signals processed through the message control means and video digitizer means;

memory means which provide retrievable storage for digitized voltage levels of video signals;

LED illumination means which illuminate all colors of each pixel at a synchronous rate and time;

pulse wave modulation means which extinguish the light individually from sets of LEDs by color within each pixel at variable times after synchronous illumination to provide a large number of color combinations;

pixel addressing means which provide X-Y row, column addressing of pixels which selectively address multiple columns and groups of rows of LEDs to reduce peak current levels and provide refresh rates which minimize apparent flicker;

pixel module means which provide serial/parallel arrays of primary colored LED means, said pixel module means providing levels of illumination required for large arrays and providing redundancy for increased pixel reliability;

primary colored LED means providing light integrally summing to provide one color of a large number of color combinations;

multiple pixel module means, in combination, providing an array of apparent point sources of light which provide a picture comprising a large number of color combinations.

31. An LED matrix display system for large number of color combination displays according to claim 30 wherein pulse wave modulation means comprise linear and non-linear pulse modulation means which provide a predetermined linear and non-linear conversion of signals from said memory means to time modulation means which provide corrections for variations in performance of LEDs of different colors across the range of signal strengths as received from the memory means.

32. A LED matrix display system for large number of color combinations LED displays according to claim 31 wherein linear and non-linear pulse modulation means comprise PROM means which provide digital patterns which control the time each LED is on for each voltage level delivered from the memory means whereby the corrections for variations in performance of LEDs of different colors across the range of signal strengths as received from the memory means are made.

33. An LED matrix display system for large number of color combinations LED displays according to claim 32 wherein PROM means comprise high frequency operational cycle means by which the PROM means is reread at a higher rate than the rate at which pixels colors are changed to provide improved refresh means to minimize flicker.

34. LED illumination apparatus adapted to a large LED matrix display system which provides an infinite number of color combinations, said LED illumination apparatus comprising:

signal source means which provide an independent signal for each primary color;

color demodulator means which separate a color signal into three color driven analog signals;

pixel module means which comprise primary colored LED pixel means, said pixel module means providing one apparent source of light in the large matrix LED display.

pulse wave modulation means comprising:

LED addressing and exciting means which address and excite each LED of each pixel to illumination at the same instant;

LED illumination extinguishing means which extinguish each LED independently at a variable time after the LEDs of a pixel have been illuminated, providing a duration of LED ON time which is dependent upon the strength of the signal from the signal source means for the color to be emitted by that LED;

pixel addressing means which provide X-Y row, column addressing of pixels which selectively address single columns and rows to reduce peak current levels and operate synchronously with an incoming video signal;

multiple pixel module means, in combination, providing an array of apparent point sources of light which provide a picture comprising an infinite number of color combinations.

35. LED illumination apparatus according to claim 34 wherein pulse wave modulation means comprise analog gating means which use analog signals directly without analog to digital conversion, the analog gating means further comprising:

sample and hold means which receive and hold in analog memory, voltage levels for signals for each LED from the signal source means;

reference waveform means which provide a time varying waveform which provides a repeatable time varying voltage signal which can be used comparatively to provide a time when an LED should be extinguished;

analog time gating means which compare voltage levels held in memory by the sample and hold means and provided by the reference waveform means and which extinguish illumination of an addressed LED at the time the ratio of the two signals cross unity.

36. An LED matrix display system for infinite variety of color combinations LED displays, comprising:

message control means which provide previously prepared messages for display;

video input receiving means which receive signals to be sent to a synchronous separator means;

synchronous separator means which separate incoming video input signals into vertical timing signals, frame timing signals, and signal to be sent to a color demodulator means;

color demodulator means which separate a color signal into three color driven analog signals;

column sample shift register means which provides gate timing means at which time sample and hold circuits are set for each pixel;

pixel addressing means which provide X-Y row addressing of pixels which selectively address single columns and rows;

pulse wave modulation means which extinguish the light individually from sets of LEDs by color within each pixel at variable times after synchronous illumination to provide an infinite number of color combinations;

LED pixel means comprising red, blue, and green LED light emitting means, the output of which integrally sums to provide one color of an infinite number of color combinations;

pixel module means, in combination, providing an array of apparent point sources of light which provide a picture comprising an infinite number of color combinations.

37. An LED matrix display system for infinite variety of color combinations LED displays according to claim 36 wherein pulse modulation means comprise analog sample and hold means and reference wave means which are gated to provide variable time periods which control the time each Led is on for each video signal voltage level.

38. An LED matrix display system for infinite variety of color combinations LED displays according to claim 37 wherein reference wave means comprise a cyclic frequency which is higher than the rate at which pixels colors are changed to provide improved refresh means to minimize flicker.

* * * * *